US005642749A

United States Patent [19]

Perryman

[11] Patent Number: 5,642,749

[45] Date of Patent: Jul. 1, 1997

[54] CRUTCH CLUTCH HOLDER

[76] Inventor: Joyce F. Perryman, 1169 Market St., #502, San Francisco, Calif. 94103

[21] Appl. No.: 604,641

[22] Filed: Feb. 21, 1996

[51] Int. Cl.[6] ..... A45B 3/00

[52] U.S. Cl. ..... 135/66; 224/407; 224/572; 224/901

[58] Field of Search ..... 135/65, 66, 68, 135/72; 224/42.33, 42.34, 42.37, 407, 563, 572, 901

[56] References Cited

U.S. PATENT DOCUMENTS

| | | | |
|---|---|---|---|
| 2,210,493 | 8/1940 | Lisi | 135/66 |
| 2,580,888 | 1/1952 | Burkett | 135/66 X |
| 3,985,148 | 10/1976 | Cadman . | |
| 4,146,045 | 3/1979 | Grant . | |
| 4,289,156 | 9/1981 | Ulics . | |
| 4,295,483 | 10/1981 | Smith . | |
| 4,428,390 | 1/1984 | Baird . | |
| 4,850,383 | 7/1989 | McBride . | |
| 4,971,593 | 11/1990 | Mayhall et al. | 224/901 X |
| 4,974,760 | 12/1990 | Miller | 224/572 X |
| 5,101,845 | 4/1992 | Kravetz . | |
| 5,311,698 | 5/1994 | Plost | 224/901 X |
| 5,340,005 | 8/1994 | Woods et al. . | |
| 5,465,884 | 11/1995 | Bohl et al. | 135/66 X |
| 5,544,745 | 8/1996 | Famorca | 224/572 X |

*Primary Examiner*—Lanna Mai
*Attorney, Agent, or Firm*—Chase & Yakimo

[57] ABSTRACT

A pouch/clutch for releasable attachment to a crutch between the arm pad and handle. The clutch is releasably attachable to the crutch for use independent of the crutch. A lower flap extends from the bottom of the clutch to hold magazines or the like upon engagement of first and second fasteners found on the lower flap. A pocket on the exterior of the clutch allows for storage of smaller items therein. The placement of the clutch between the arm pad and handle further positions the clutch between the arm and torso of the user so as to diminish third person access thereto and thus enhance security. The releasable attachment of the clutch to the crutch enables the user to easily access the clutch independent of the crutch. Such access precludes the need to manipulate the crutch for access to the associated clutch.

12 Claims, 7 Drawing Sheets

CRUTCH CLUTCH HOLDER

BACKGROUND OF THE INVENTION

This invention relates to a pouch for use with a crutch or the like, and more particularly, to a pouch releasably mounted to the crutch in a convenient and secure position, the pouch including means for transporting different sizes of items and documents, such as magazines or the like.

As shown by the patents accompanying the submission of my patent application, inclusive of the patent references cited in such patents, there is a desire to enable a person to transport articles during crutch-assisted ambulatory movement. These devices include various pouches attached to the crutch such as shown in U.S. Pat. No. 4,295,483 to Smith on Oct. 20, 1981. One problem with this type of pouch is that it is mounted below the handle which delimits an easy access to the pouch by the crutch user. This location also decreases the security of the pouch as the pouch is readily accessible to other persons. Moreover, the pouch cannot transport relatively larger paper documents such as medical records, magazines or the like.

U.S. Pat. No. 5,101,845 addresses the transport of paper articles. However, the clamping device shown therein appears to be relatively cumbersome and requires modification to the crutch proper. Such structure could interfere with the crutch-assisted ambulatory movement of the user.

Also, the latter device requires significant modification to the crutch structure which will increase the cost. Such device may not be used by one-time users who are renting crutches as permanent modifications cannot be made to such leased crutches. Finally, the prior pouches are not readily releasable from the crutch when the user is at the sites of departure or destination. Thus, it may become awkward to gain access to such pouch by the user without manipulation of the crutch itself.

In response thereto I have invented a clutch for transport of both personal items and documents, the clutch being releasably attached to the crutch between the underarm brace and handle. The clutch is thus positioned adjacent the torso of the crutch user so as to enable easy access thereto while limiting access to other persons. My clutch includes a flexible holder for releasable transport of magazines and the like. The clutch is also easily removable from the crutch so as to allow easy access thereto independent of the crutch.

It is therefore a general object of this invention to provide a clutch for transport of articles of various sizes by a crutch-assisted user.

It is another object of this invention to provide a device, as aforesaid, which is releasably attachable to a crutch frame.

Still another object of this invention is to provide a device, as aforesaid, which is releasably attachable to the crutch between the crutch arm pad and handle displaced therebelow.

It is still a further object of this invention to provide a device, as aforesaid, which is easily accessible by the crutch-assisted user while limiting access by other persons.

A more particular object of this invention is to provide a device, as aforesaid, which enables the user to transport documents, such as magazines or the like.

Another particular object of this invention is to provide a device, as aforesaid, having a pocket on the outside thereof for storage of smaller items outside the clutch proper.

Other objects and advantages of this invention will become apparent from the following description taken in connection with the accompanying drawings, wherein is set forth by way of illustration and example, a now preferred embodiment of this invention.

DESCRIPTION OF THE PREFERRED EMBODIMENT

Figure 1:
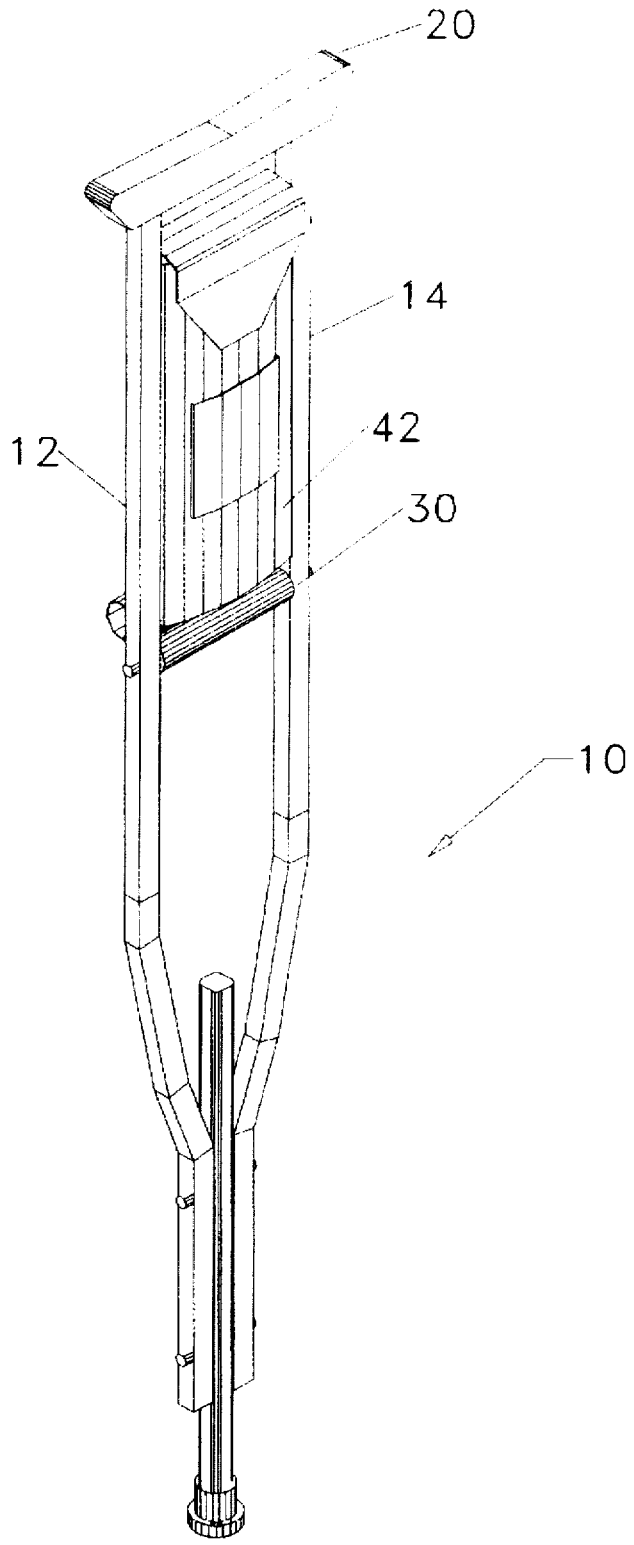
FIG. 1 is a perspective view of a crutch with the clutch in place.
Figure 2:
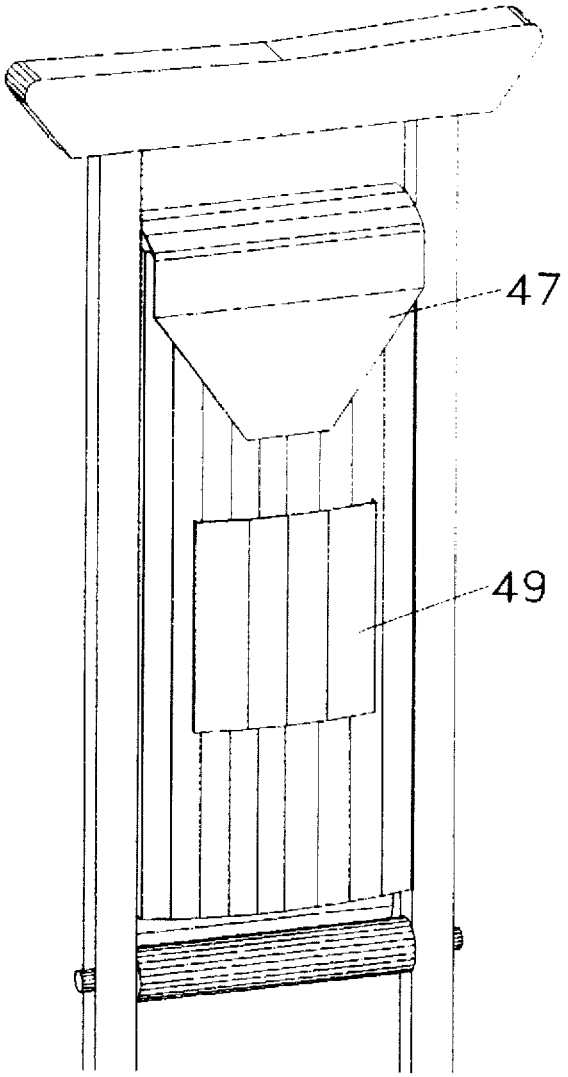
FIG. 2 is a fragmentary view of the top end of the crutch showing the clutch in place on an enlarged scale.
Figure 3:
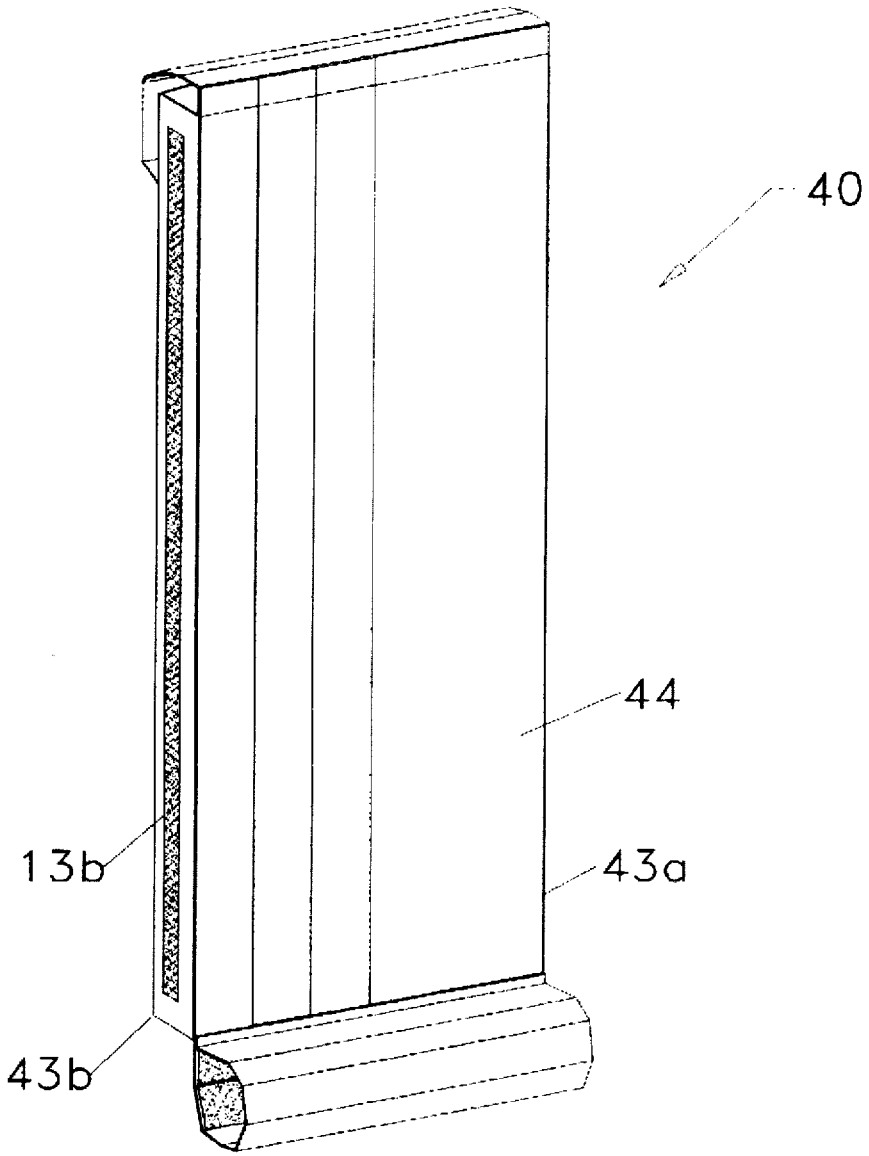
FIG. 3 is a rear view of the clutch removed from the crutch.

Turning more particularly to the drawings, FIG. 1 shows a perspective view of a crutch 10 with a clutch 40 in place. The crutch 10 is of a conventional design, including a crutch arm pad 20 with handle 30 therebelow extending between the vertical struts or side rails 12, 14 of the crutch 10.

Figure 4:
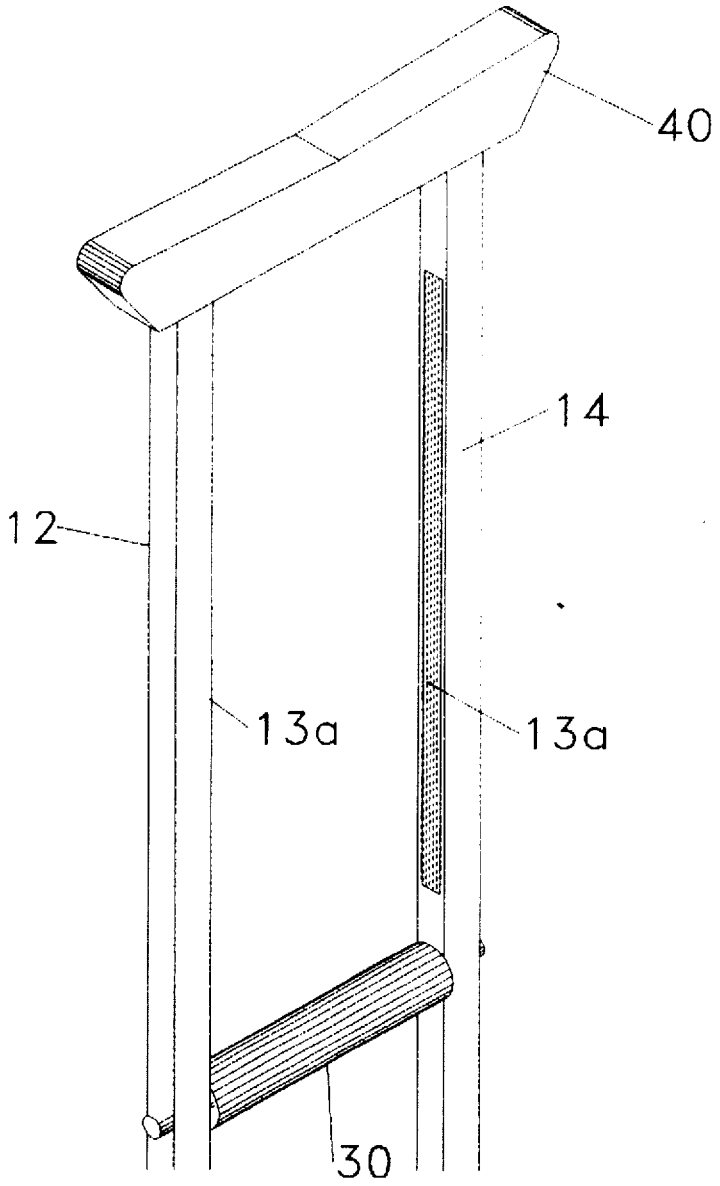
FIG. 4 is a fragmentary view of a top portion of a crutch
Figure 5:
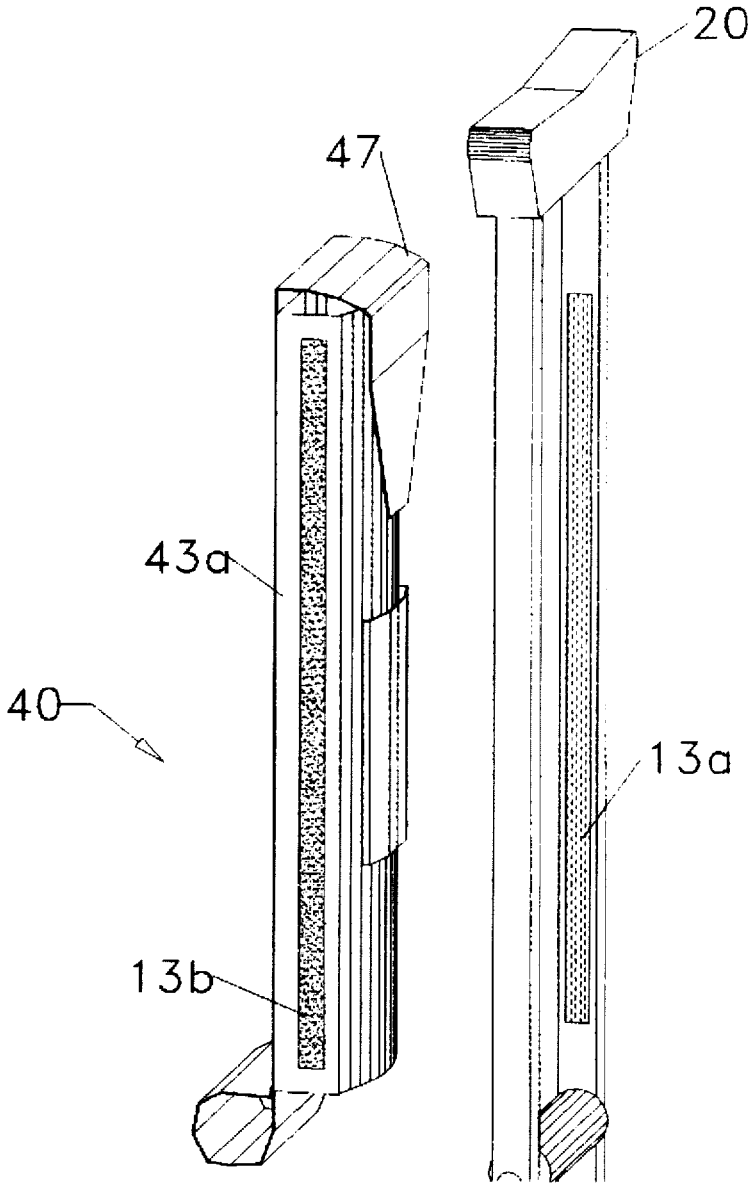
FIG. 5 is a perspective view of a top portion of the crutch showing the clutch displaced from the crutch.
Figure 6:
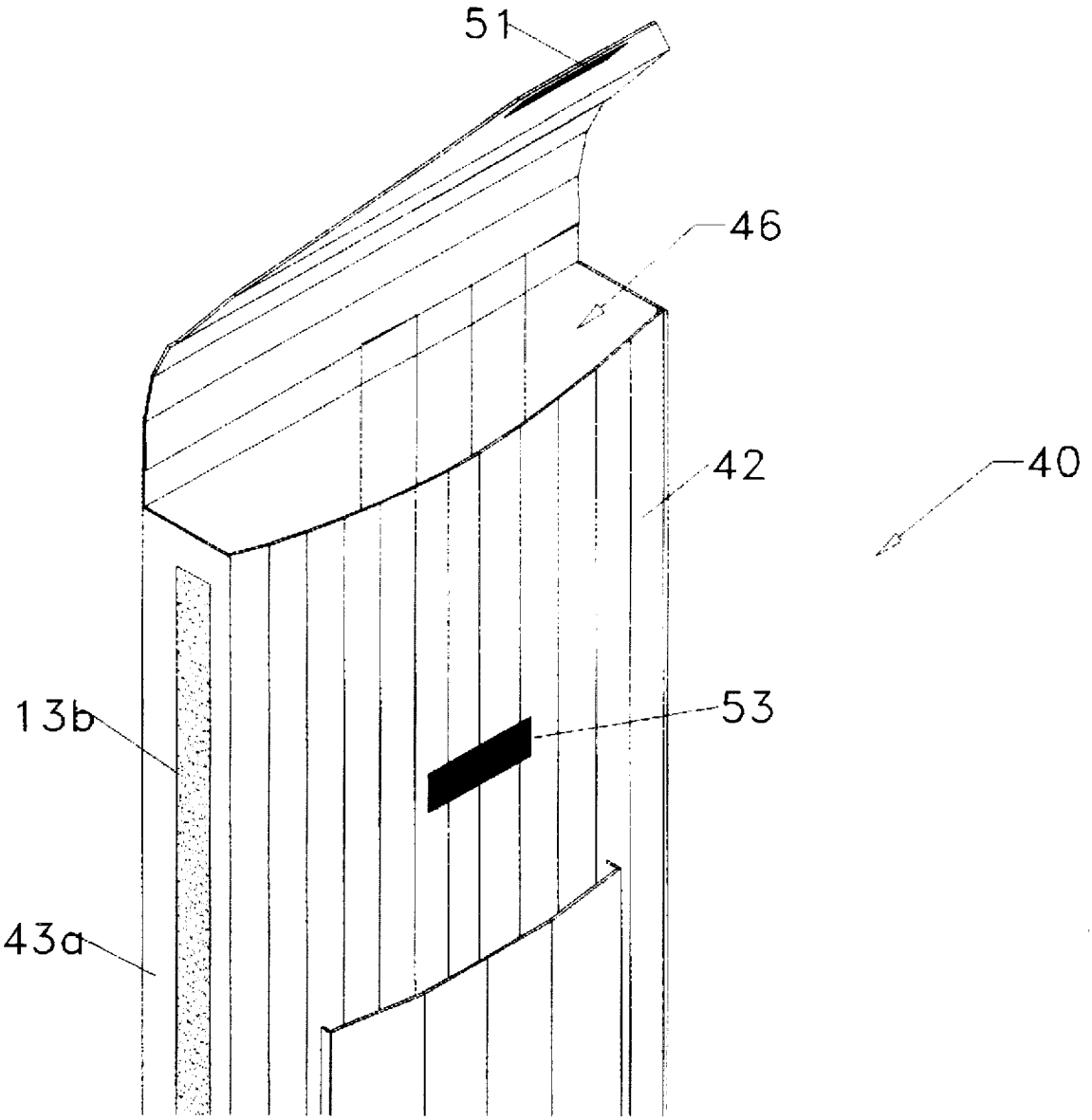
FIG. 6 is a fragmentary perspective view on an enlarged scale of top portion of the clutch.
Figure 7:
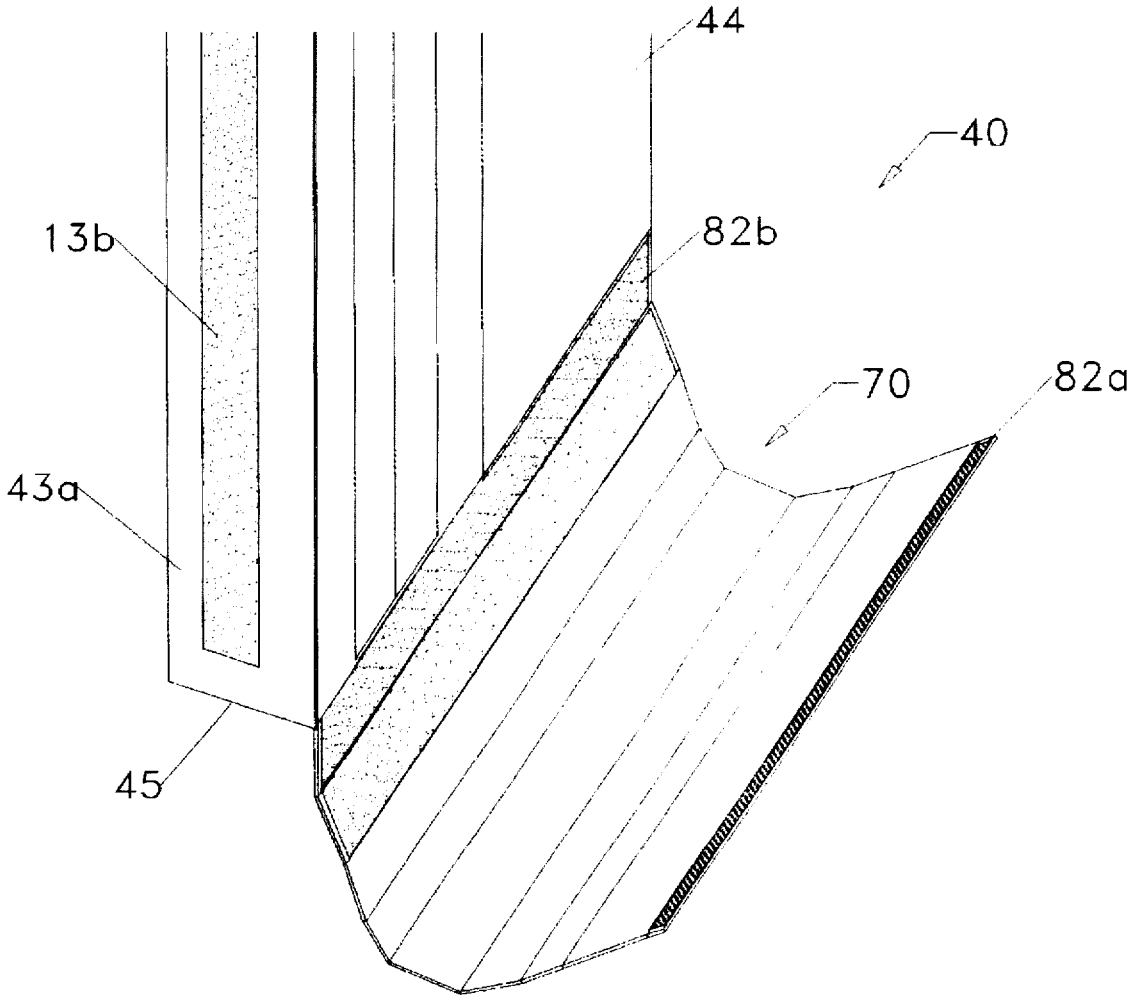
FIG. 7 is a fragmentary perspective view of the bottom of the clutch, on an enlarged scale, showing the document holder.
Figure 1:
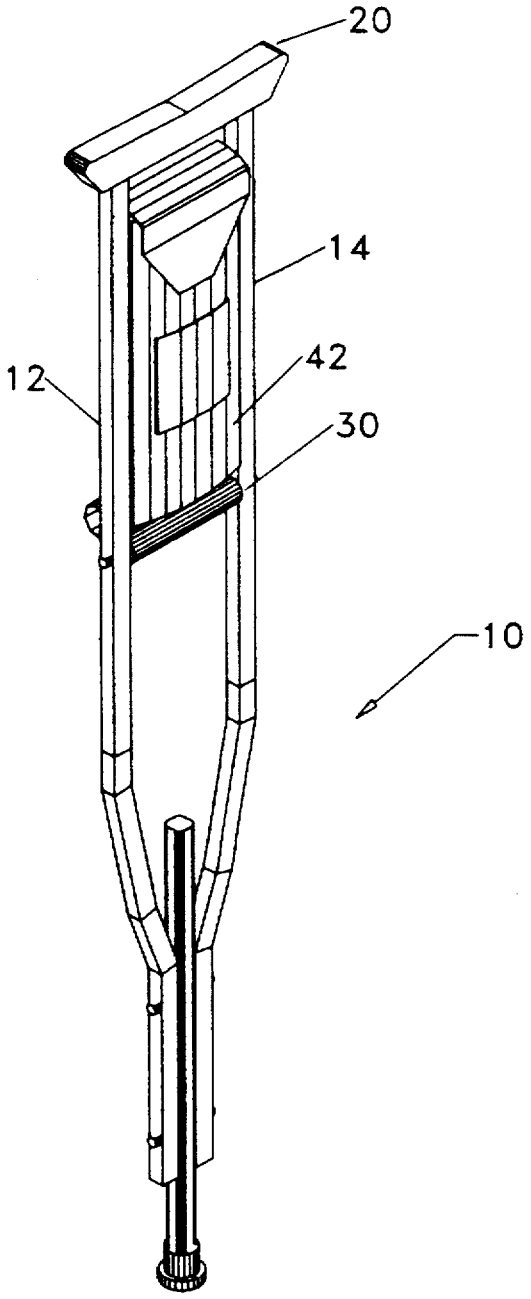
Figure 2:
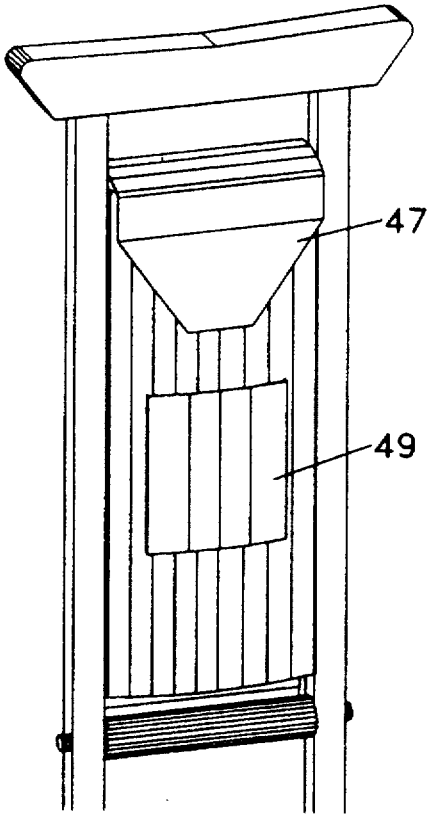
Figure 3:
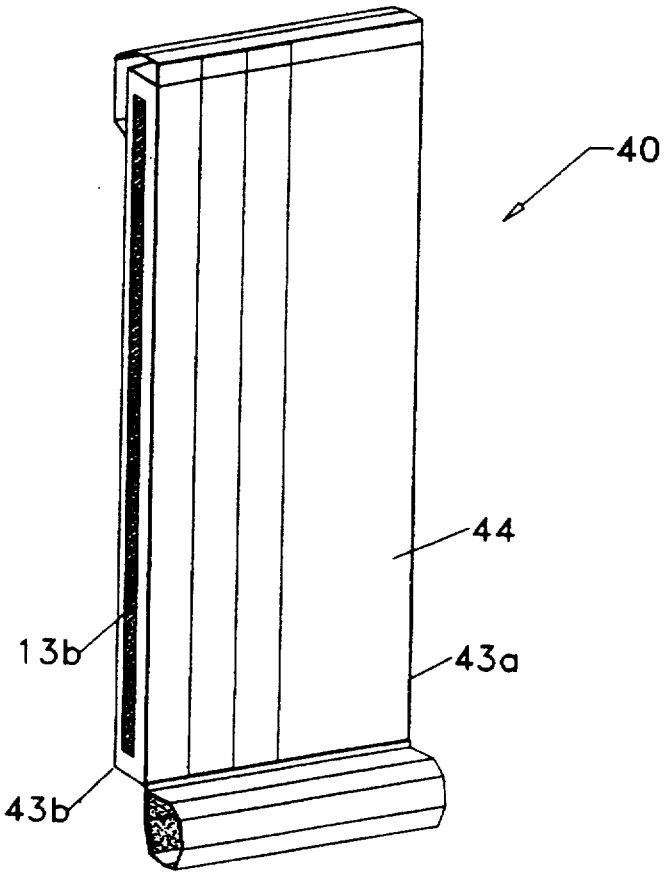
Figure 4:
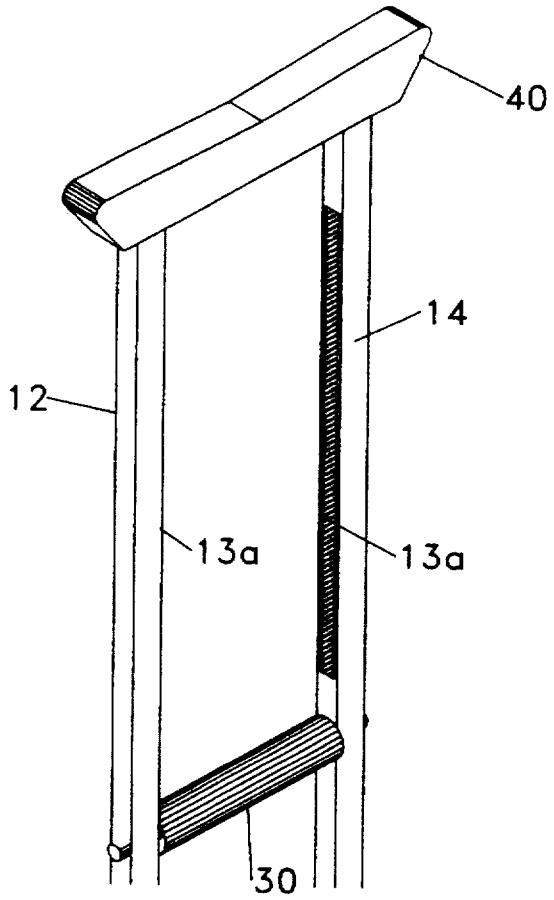
Figure 5:
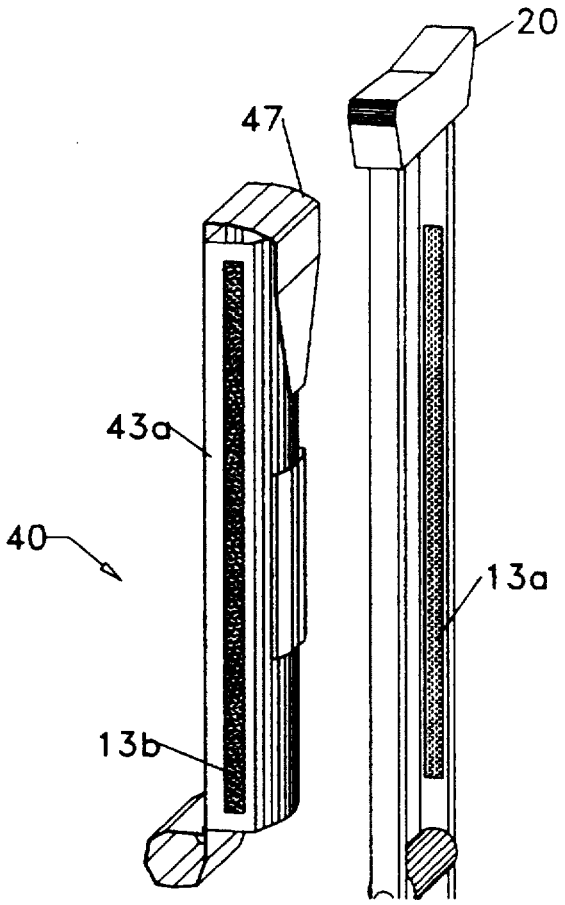
Figure 6:
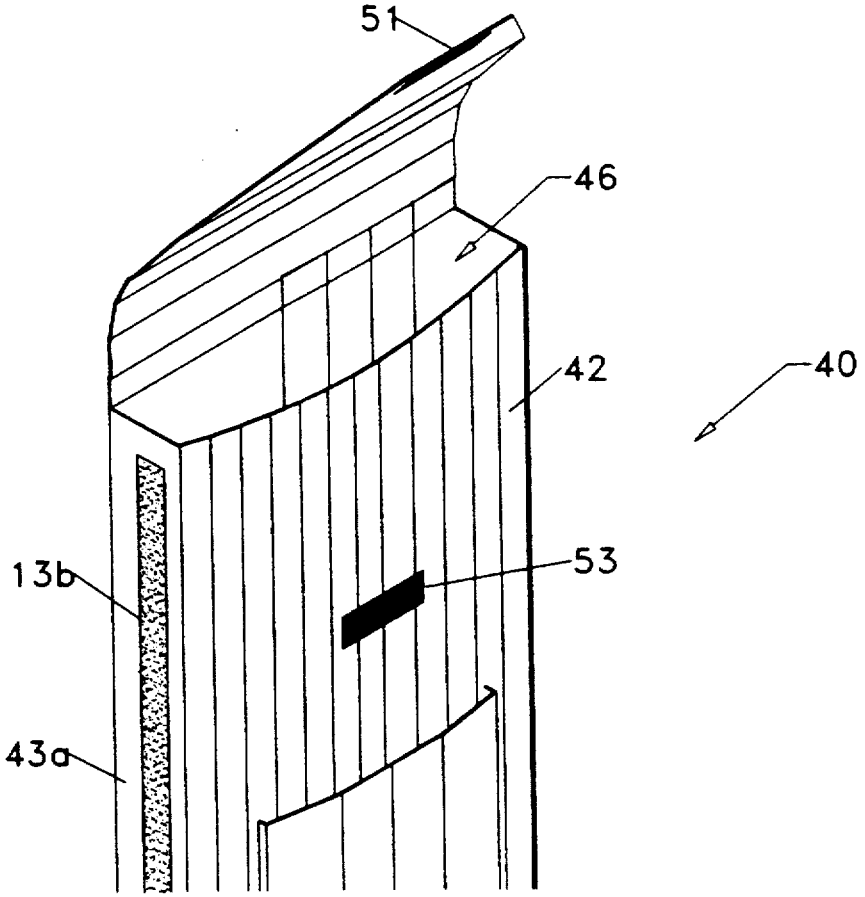
Figure 7:
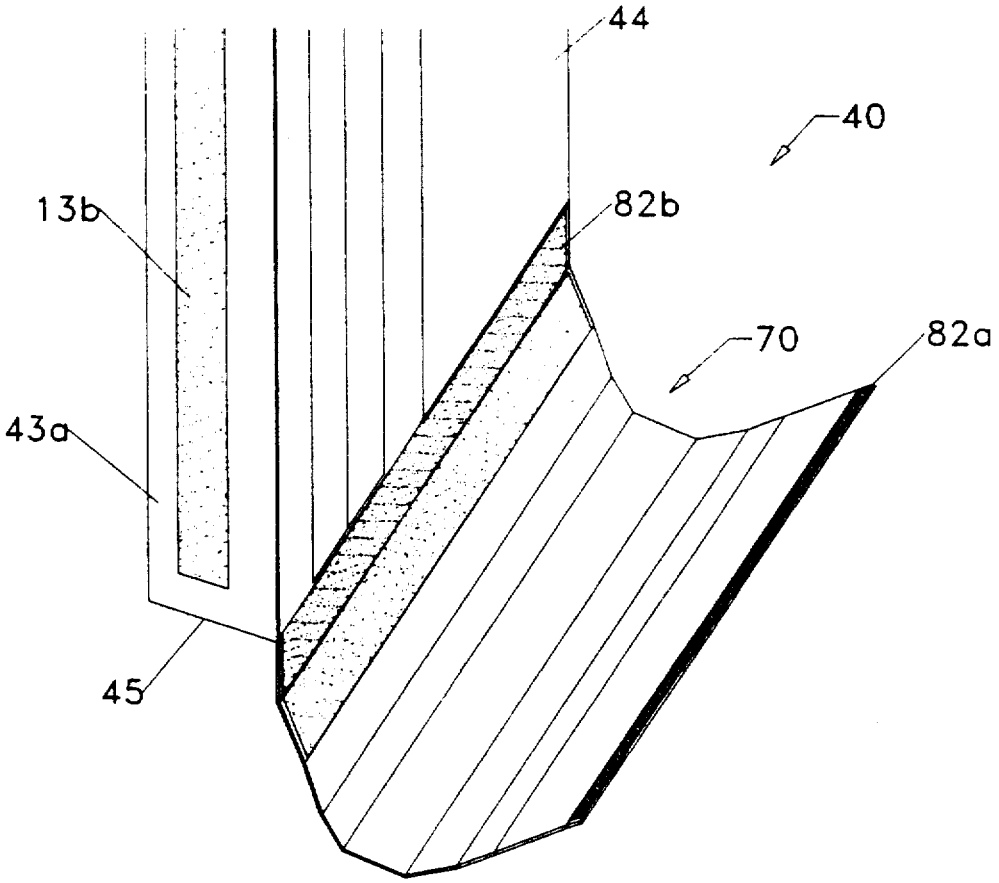
Figure 1:
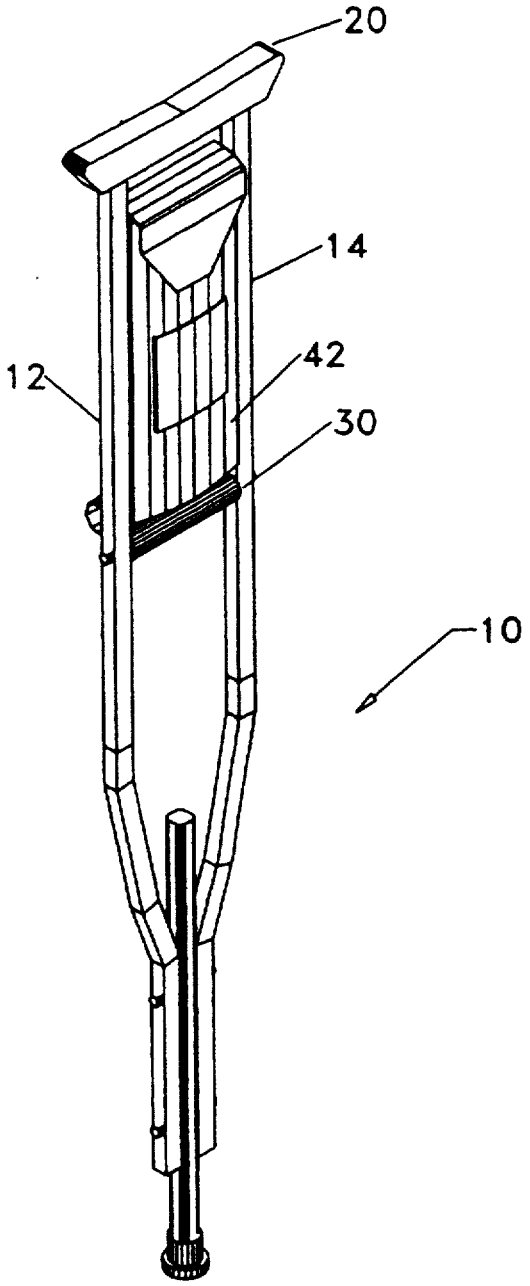
Figure 2:
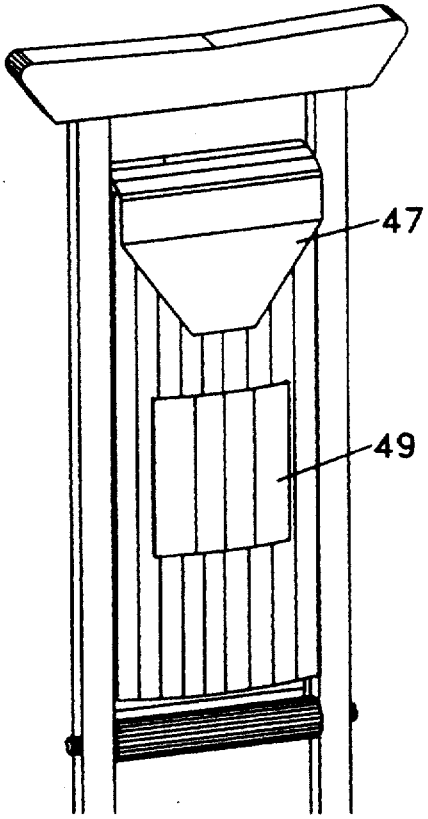
Figure 3:
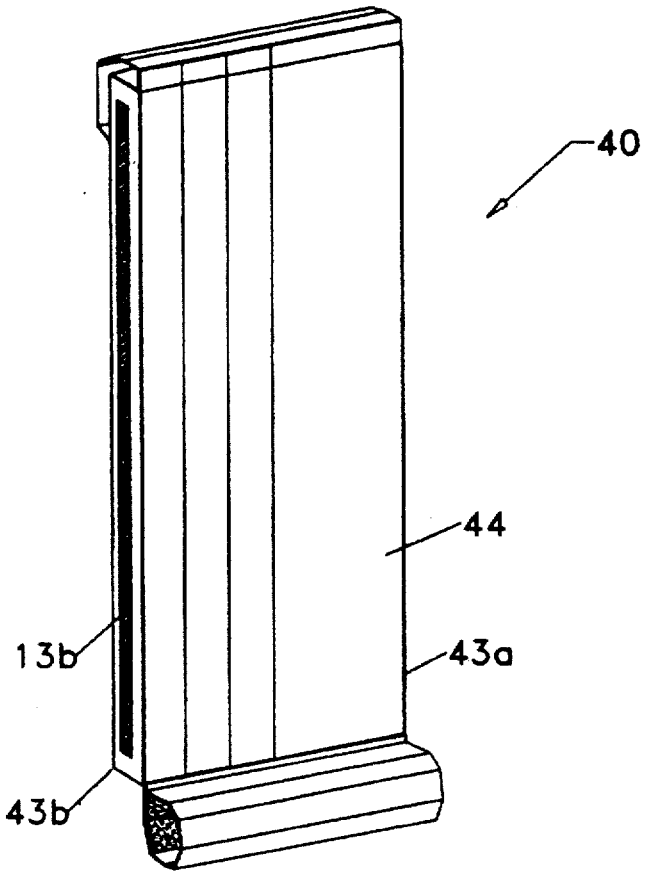
Figure 4:
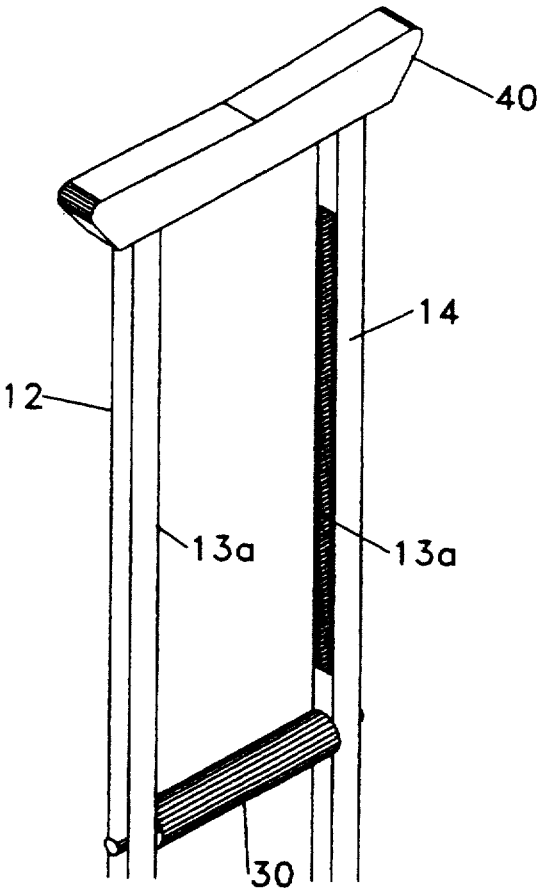
Figure 5:
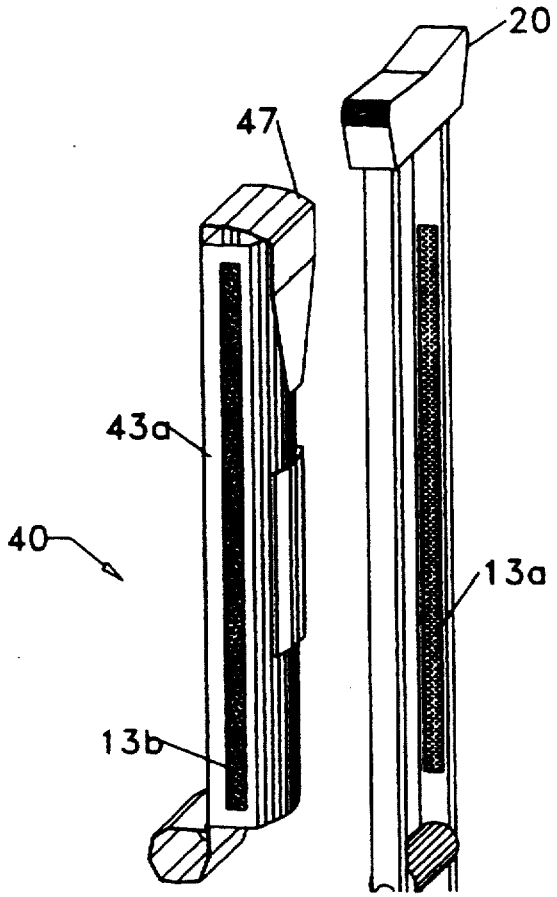
Figure 6:
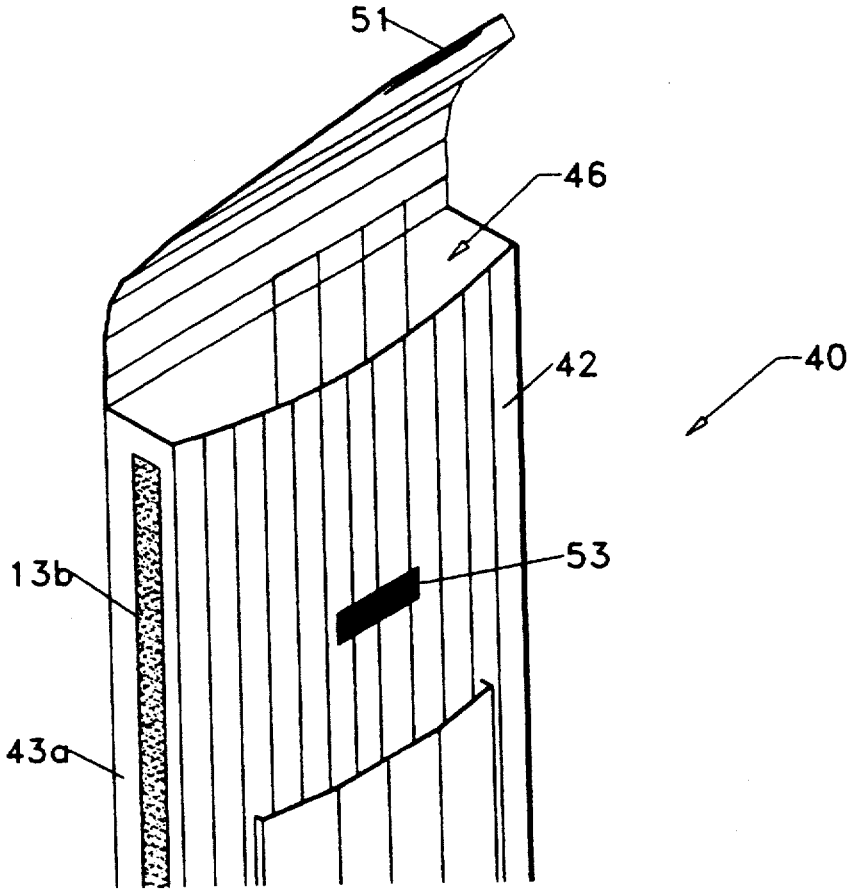
Figure 7:
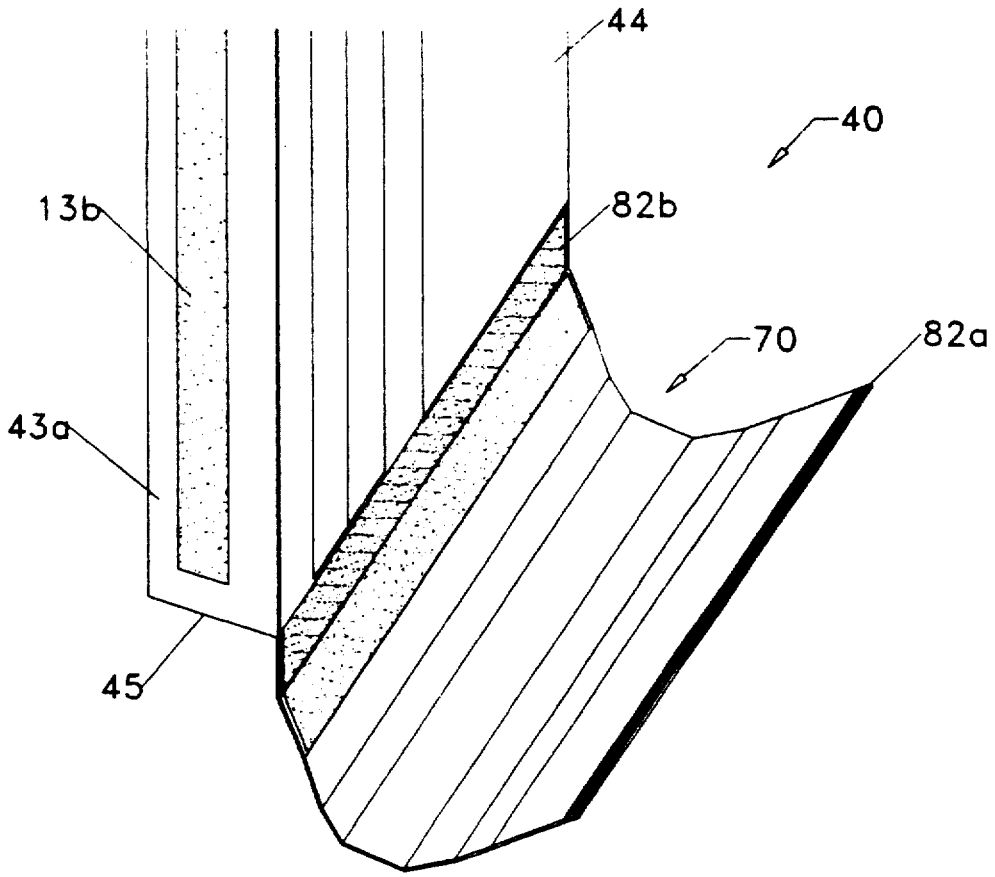

As shown in FIG. 4, Velcro® strips 13*a* extend along the interior surface of side rails 12, 14 for mating with complementary Velcro® fastener strips 13*b* positioned on the clutch proper 40 as to be subsequently described.

The clutch/pouch 40 is preferably made of a flexible material. The pouch presents front 42 and rear 44 walls with side walls 43*a*, 43*b* extending therebetween. A bottom wall 45 extends between the front 42 and rear 44 walls. The front wall 42 combines with the rear wall 44 and side walls 43*a*, 43*b* so as to present an opening 46 at the top thereof. Velcro® strips 13*b* extend along the side walls 43*a*, 43*b* of pouch 40 for fastening to the complementary Velcro® strips 13*a* found on the side rails.

Extending from the top of rear wall 44 of pouch 40 is a flap 47 for releasably closing the opening 46 presented at the top of the clutch 40 upon engagement of Velcro® fasteners 51, 53. A pocket 49 is also positioned on the front wall 42 of the clutch 40 for providing storage of smaller items therein.

Extending from the Juncture of the rear wall 44 and bottom wall 45 is a flap 70 of flexible material having a Velcro® strip 82*a* at the free end of flap 70. The Velcro® strip 82*a* engages a complementary Velcro® strip 82*b* extending along the juncture of the flap 70 and rear wall 44. Upon engagement of the complementary Velcro® fastener strips 82*a*, 82*b*, articles placed on the flap 70, such as magazines or the like, are secured within the rolled flap 70.

In use the clutch 40 is attached to the crutch 10 by engagement of the Velcro® strips 13*a* on the crutch with strips 13*b* on the side walls 43*a*, 43*b* of the clutch. Clutch 40 is thus easily removable from the crutch 10 so as to allow for easy user access thereto independent of the crutch 10. Thus, there is no need to manipulate the crutch 10 so as to access the clutch 40.

Accordingly, at the user's site of departure, articles may easily be placed in the clutch 40 prior to engagement to the crutch 10. Smaller articles may also be placed in the pocket 49. Finally, rolled up documents such as magazines or the like may be secured by operation of the flap 70.

During ambulatory movement the clutch 40 is positioned between the user's arm and torso so as to limit access thereto by other persons. Thus, the security of the transported items is enhanced by clutch 40. However, the position of the clutch 40 between the handle 30 and the arm pad 20 allows for convenient access thereto without extraordinary manipulation of the clutch 10. It is also understood that during ambulatory movement the documents transported within engaged flap 70 are positioned between the crutch 10 and the user's body so as to delimit access by other persons thereto. Finally, the pocket 49 allows for easy access to smaller articles without the need to open the clutch 40.

Accordingly, my clutch 40 presents a pouch for transport of articles of various sizes as well as paper documents such as magazines or the like. As my clutch/pouch 40 is easily releasable from the crutch 10, easy access is allowed to the clutch 40 independent of the crutch 10. Thus, there is no need to manipulate the crutch 10 to gain access to the clutch 40 when the user is at her departure or arrival sites.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. For attachment to a crutch having a pair of vertical side rails with a top arm pad and a handle therebelow, a clutch comprising:

a compartment presenting front and back walls with side walls therebetween, the front and back walls having a width approximating a width between the side rails of the crutch;

a first fastener means along said side walls of said compartment;

a second complementary fastener means located along the side rails below the arm pad and above the handle for engagement with said first fastener means to position said clutch between the arm pad and the handle of the crutch.

2. The clutch as claimed in claim 1 further comprising an upper flap extending from a top of one of said front or back walls, said flap having a fastener at a free end thereof for engagement with a complementary fastener on the other of said front or back walls, said engagement covering an opening presented at a top free edge of said compartment walls.

3. The clutch as claimed in claim 2 further comprising:

a flap extending from one of said front or back walls;

a third fastener means extending along a juncture of one end of said flap and said front or back walls;

a fourth fastener means extending along a free end of said flap, an engagement of said third and fourth fastener means securing an article placed therebetween.

4. The clutch as claimed in claim 1 further comprising a pocket on either said front or back walls.

5. The clutch as claimed in claim 1 further comprising:

a flap extending from one of said front or back walls;

a third fastener means extending along a juncture of one end of said flap and said front or back walls;

a fourth fastener means extending along a free end of said flap, an engagement of said third and fourth fastener securing an article placed therebetween.

6. The clutch as claimed in claim 5 wherein said flap extends from a Juncture of one of said front or back walls and a bottom wall of said compartment.

7. For attachment to a crutch having a pair of vertical side rails with a top arm pad and a handle therebelow, a clutch comprising:

a pouch;

a pair of opposed first fastener means on said pouch;

a second pair of complementary opposed fastener means located along the side rails below the arm pad and above the handle for engagement with said first fastener means to position said pouch between the arm pad and the handle of the crutch.

8. The clutch as claimed in claim 7 further comprising a pocket on an outside of said pouch.

9. The clutch as claimed in claim 7 further comprising:

a flap extending from said pouch;

a third fastener means extending along a Juncture of one end of said flap and said pouch;

a fourth fastener means extending along a free end of said flap, an engagement of said third and fourth fastener securing an article placed on said flap.

10. The clutch as claimed in claim 9 wherein said flap extends from a bottom of said pouch.

11. For attachment to a crutch having a pair of vertical side rails with a top arm pad and handle therebelow, a clutch comprising:

a pouch;

means for securing said pouch between the side rails of said crutch;

a flap extending from said pouch;

a first fastener means extending along a Juncture of one end of said flap and said pouch;

a second fastener means extending along a free end of said flap, an engagement of said first and second fastener securing an article placed on said flap.

12. The clutch as claimed in claim 11 wherein said juncture is at a bottom of said pouch.

* * * * *

UNITED STATES PATENT AND TRADEMARK OFFICE

CERTIFICATE OF CORRECTION

PATENT NO. : 5,642,749
DATED : July 1, 1997
INVENTOR(S) : Joyce F. Perrman

It is certified that error appears in the above-identified patent and that said Letters Patent is hereby corrected as shown below:

The title page should be deleted to appear as per attached title page.

The drawing sheets consisting of Figs. 1-7 should be deleted to appear as per attached drawing Figs. 1-7.

Signed and Sealed this

Twenty-third Day of September, 1997

*Attest:*

*Attesting Officer*

BRUCE LEHMAN

*Commissioner of Patents and Trademarks*

United States Patent [19]

Perryman

[11] Patent Number: 5,642,749

[45] Date of Patent: Jul. 1, 1997

[54] CRUTCH CLUTCH HOLDER

[76] Inventor: Joyce F. Perryman, 1169 Market St., #502, San Francisco, Calif. 94103

[21] Appl. No.: 604,641

[22] Filed: Feb. 21, 1996

[51] Int. Cl.[6] ..... A45B 3/00

[52] U.S. Cl. ..... 135/66; 224/407; 224/572; 224/901

[58] Field of Search ..... 135/65, 66, 68, 135/72; 224/42.33, 42.34, 42.37, 407, 563, 572, 901

[56] References Cited

U.S. PATENT DOCUMENTS

| | | | |
|---|---|---|---|
| 2,210,493 | 8/1940 | Lisi | 135/66 |
| 2,580,888 | 1/1952 | Burkett | 135/66 X |
| 3,985,148 | 10/1976 | Cadman . | |
| 4,146,045 | 3/1979 | Grant . | |
| 4,289,156 | 9/1981 | Ulics . | |
| 4,295,483 | 10/1981 | Smith . | |
| 4,428,390 | 1/1984 | Baird . | |
| 4,850,383 | 7/1989 | McBride . | |
| 4,971,593 | 11/1990 | Mayhall et al. | 224/901 X |
| 4,974,760 | 12/1990 | Miller | 224/572 X |
| 5,101,845 | 4/1992 | Kravetz . | |
| 5,311,698 | 5/1994 | Plost | 224/901 X |
| 5,340,005 | 8/1994 | Woods et al. . | |
| 5,465,884 | 11/1995 | Bohl et al. | 135/66 X |
| 5,544,745 | 8/1996 | Famorca | 224/572 X |

*Primary Examiner*—Lanna Mai
*Attorney, Agent, or Firm*—Chase & Yakimo

[57] ABSTRACT

A pouch/clutch for releasable attachment to a crutch between the arm pad and handle. The clutch is releasably attachable to the crutch for use independent of the crutch. A lower flap extends from the bottom of the clutch to hold magazines or the like upon engagement of first and second fasteners found on the lower flap. A pocket on the exterior of the clutch allows for storage of smaller items therein. The placement of the clutch between the arm pad and handle further positions the clutch between the arm and torso of the user so as to diminish third person access thereto and thus enhance security. The releasable attachment of the clutch to the crutch enables the user to easily access the clutch independent of the crutch. Such access precludes the need to manipulate the crutch for access to the associated clutch.

12 Claims, 7 Drawing Sheets

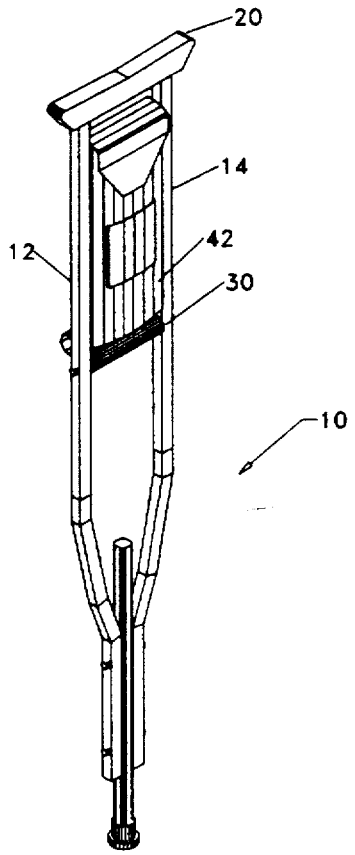

UNITED STATES PATENT AND TRADEMARK OFFICE

CERTIFICATE OF CORRECTION

PATENT NO. : 5,642,749
DATED : July 1, 1997
INVENTOR(S) : Joyce F. Perryman

It is certified that error appears in the above-identified patent and that said Letters Patent is hereby corrected as shown below:

The title page should be deleted to appear as per attached title page.

The Drawing sheets consisting of Figs. 1-7 should be deleted to appear as per attached drawing Figs. 1-7.

This certificate supersedes Certificate of Correction issued September 23, 1997.

Signed and Sealed this

Twenty-eighth Day of October, 1997

*Attest:*

Bruce Lehman

BRUCE LEHMAN

*Attesting Officer*

*Commissioner of Patents and Trademarks*

United States Patent [19]

Perryman

[11] Patent Number: 5,642,749

[45] Date of Patent: Jul. 1, 1997

[54] CRUTCH CLUTCH HOLDER

[76] Inventor: Joyce F. Perryman, 1169 Market St., #502, San Francisco, Calif. 94103

[21] Appl. No.: 604,641

[22] Filed: Feb. 21, 1996

[51] Int. Cl.[6] ..... A45B 3/00

[52] U.S. Cl. ..... 135/66; 224/407; 224/572; 224/901

[58] Field of Search ..... 135/65, 66, 68, 135/72; 224/42.33, 42.34, 42.37, 407, 563, 572, 901

[56] References Cited

U.S. PATENT DOCUMENTS

| | | | |
|---|---|---|---|
| 2,210,493 | 8/1940 | Lisi | 135/66 |
| 2,580,888 | 1/1952 | Burkett | 135/66 X |
| 3,985,148 | 10/1976 | Cadman . | |
| 4,146,045 | 3/1979 | Grant . | |
| 4,289,156 | 9/1981 | Ulics . | |
| 4,295,483 | 10/1981 | Smith . | |
| 4,428,390 | 1/1984 | Baird . | |
| 4,850,383 | 7/1989 | McBride . | |
| 4,971,593 | 11/1990 | Mayhall et al. | 224/901 X |
| 4,974,760 | 12/1990 | Miller | 224/572 X |
| 5,101,845 | 4/1992 | Kravetz . | |
| 5,311,698 | 5/1994 | Plost | 224/901 X |
| 5,340,005 | 8/1994 | Woods et al. . | |
| 5,465,884 | 11/1995 | Bohl et al. | 135/66 X |
| 5,544,745 | 8/1996 | Pamorca | 224/572 X |

*Primary Examiner*—Lanna Mai
*Attorney, Agent, or Firm*—Chase & Yakimo

[57] ABSTRACT

A pouch/clutch for releasable attachment to a crutch between the arm pad and handle. The clutch is releasably attachable to the crutch for use independent of the crutch. A lower flap extends from the bottom of the clutch to hold magazines or the like upon engagement of first and second fasteners found on the lower flap. A pocket on the exterior of the clutch allows for storage of smaller items therein. The placement of the clutch between the arm pad and handle further positions the clutch between the arm and torso of the user so as to diminish third person access thereto and thus enhance security. The releasable attachment of the clutch to the crutch enables the user to easily access the clutch independent of the crutch. Such access precludes the need to manipulate the crutch for access to the associated clutch.

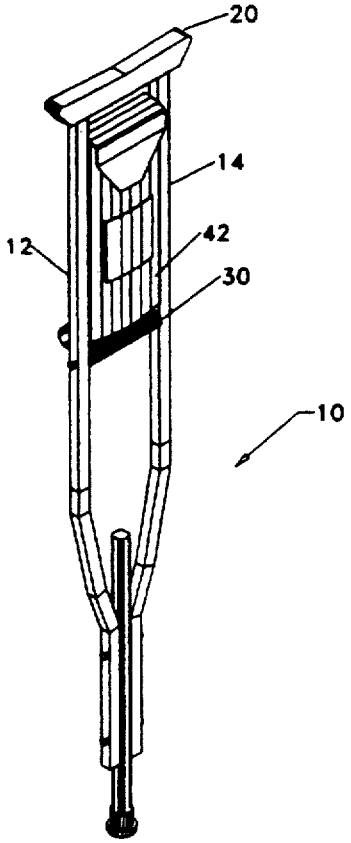

12 Claims, 7 Drawing Sheets